US006163967A

United States Patent [19]

Suzuki et al.

[11] Patent Number: 6,163,967

[45] Date of Patent: Dec. 26, 2000

[54] SPECTACLE LENS SHAPE MEASURING APPARATUS

[75] Inventors: Yasuo Suzuki; Kenichi Watanabe; Yasuto Eto, all of Tokyo, Japan

[73] Assignee: Kabushiki Kaisha Topcon, Tokyo, Japan

[21] Appl. No.: 09/083,441

[22] Filed: May 22, 1998

[30] Foreign Application Priority Data

May 26, 1997 [JP] Japan ..... 9-151636

[51] Int. Cl.[7] ..... G01B 5/20; G01B 21/20

[52] U.S. Cl. ..... 33/200; 33/507

[58] Field of Search ..... 33/28, 200, 507, 33/551, 546; 73/104

[56] References Cited

U.S. PATENT DOCUMENTS 5,228,242 7/1993 Matsuyama ..... 451/8
5,501,017 3/1996 Suzuki ..... 33/200
5,515,612 5/1996 Igarashi et al. ..... 33/200
5,959,199 9/1999 Suzuki et al. ..... 73/104
6,006,592 12/1999 Sukuki et al. ..... 73/104

FOREIGN PATENT DOCUMENTS 61-267732 11/1986 Japan .
3-261814 11/1991 Japan .
4-93163 3/1992 Japan .

*Primary Examiner*—Andrew H. Hirshfeld
*Assistant Examiner*—R A Smith
*Attorney, Agent, or Firm*—Finnegan, Henderson, Farabow, Garrett and Dunner, L.L.P.

[57] ABSTRACT

An apparatus is provided for measuring the contour of a lens frame of an eyeglass frame and measuring the shape of a template. The apparatus has at least a pair of holding hooks (43, 44) for holding the rim of the eyeglass frame from above and below. The apparatus is constructed to hold a template holder (100) of a template (T) by the holding hooks (43, 44).

12 Claims, 7 Drawing Sheets

SPECTACLE LENS SHAPE MEASURING APPARATUS

BACKGROUND OF THE INVENTION

1. Field of the Invention

This invention relates to an apparatus for measuring the contour of a lens frame (i.e., rim) of an eyeglass frame or measuring the shape of, for example, a template.

2. Description of the Related Art

As disclosed by, for example, Japanese Patent Application (published before examination) No. Sho 61-267732, Japanese Patent Application (published before examination) No. Hei 3-261814, or Japanese Patent Application (published before examination) No. Hei 4-93163, a conventional spectacle-lens-shape measuring apparatus is constructed to clamp the rim of an eyeglass frame from above and below by means of clamp pins (holding rods).

In this apparatus, however, a template holder must be fastened to an apparatus body by means of screws, in order to hold a template. Thus, much labor is required for screwing the template holder.

SUMMARY OF THE INVENTION

It is therefore an object of the present invention to provide a spectacle lens shape measuring apparatus having a template holder which is swiftly attachable to the body of the apparatus without much labor.

In order to achieve the object, a spectacle lens shape measuring apparatus for measuring the contour of the rim of an eyeglass frame and the contour of a template comprises first and second holding rods for holding the rim of the eyeglass frame from above and below, and a template holding member including a portion to be held by means of the pair of holding rods.

Preferably, the template holding member comprises a square upper wall and a side wall extending downward from the edge of the upper wall. The upper wall includes a portion for holding the template on the under surface in the center thereof. The side wall includes a V-shaped notch engaged with the first holding rod in the lower edge thereof and an insertion hole situated above the notch into which the second holding rod is inserted, and the part between the notch of the side wall and the insertion hole is the portion to be held.

Further, an apparatus body may include a pair of movable frames for holding the holding rods and regulating the measurement positions of the eyeglass frame and the template holding member by disposing the pair of movable frames to approach one another and recede from one another, and means for urging the movable frames in a direction to approach one another.

Further, the apparatus may be constructed such that the pair of movable frames include a pair of vertical plate portions parallel to one another and perpendicular to the direction in which the movable frames come close to and recede from one another, the pair of vertical plate portions include a space to dispose and hold the eyeglass frame or the template holding member therebetween, the movable frames include base portions of the pair of holding rods held on the side opposite to the holding space therein, and the vertical plate portions include openings through which the pair of holding rods are projected into the holding space.

Further, the apparatus may be constructed such that the first holding rod is projected into the holding space and the second holding rod is held on the movable frames so as to be freely moved into and out of the openings and freely moved close to and away from the first holding rod.

Further, the apparatus may be constructed such that the first and second holding rods are connected to each other at the base portion so that front ends of the first and second holding rods freely move up and down to conduct an opening and closing movement, and are urged in a direction to conduct an opening movement by means of a spring. The apparatus is provided with a regulating means for regulating an upward movement of the second holding rod, and the first holding rod is disposed to freely move up and down while keeping its axial line perpendicular to the vertical plate portion. The apparatus is further provided an operating means for moving the first holding rod up and down, and a length of the second holding rod is designed such that when the operating means allows the first holding rod to move up and down, the second holding rod conducts an opening and closing movement with respect to the first holding rod under action of the regulating means and projects into the space through the opening.

BRIEF DESCRIPTION OF THE DRAWINGS

FIGS. 1(*b*) and 1(*c*) are sectional views showing the relationship between a barrel shaft and an operating shaft of FIG. 1(*a*).

FIG. 1(*d*) is a perspective view of a holding hook.

FIG. 6(*b*) shows the template holder of FIG. 6(*a*) turned over.

DESCRIPTION OF THE PREFERRED EMBODIMENTS

Embodiments of a spectacle lens shape measuring apparatus according to the present invention will be described hereinafter with reference to the attached drawings.

Figure 2:
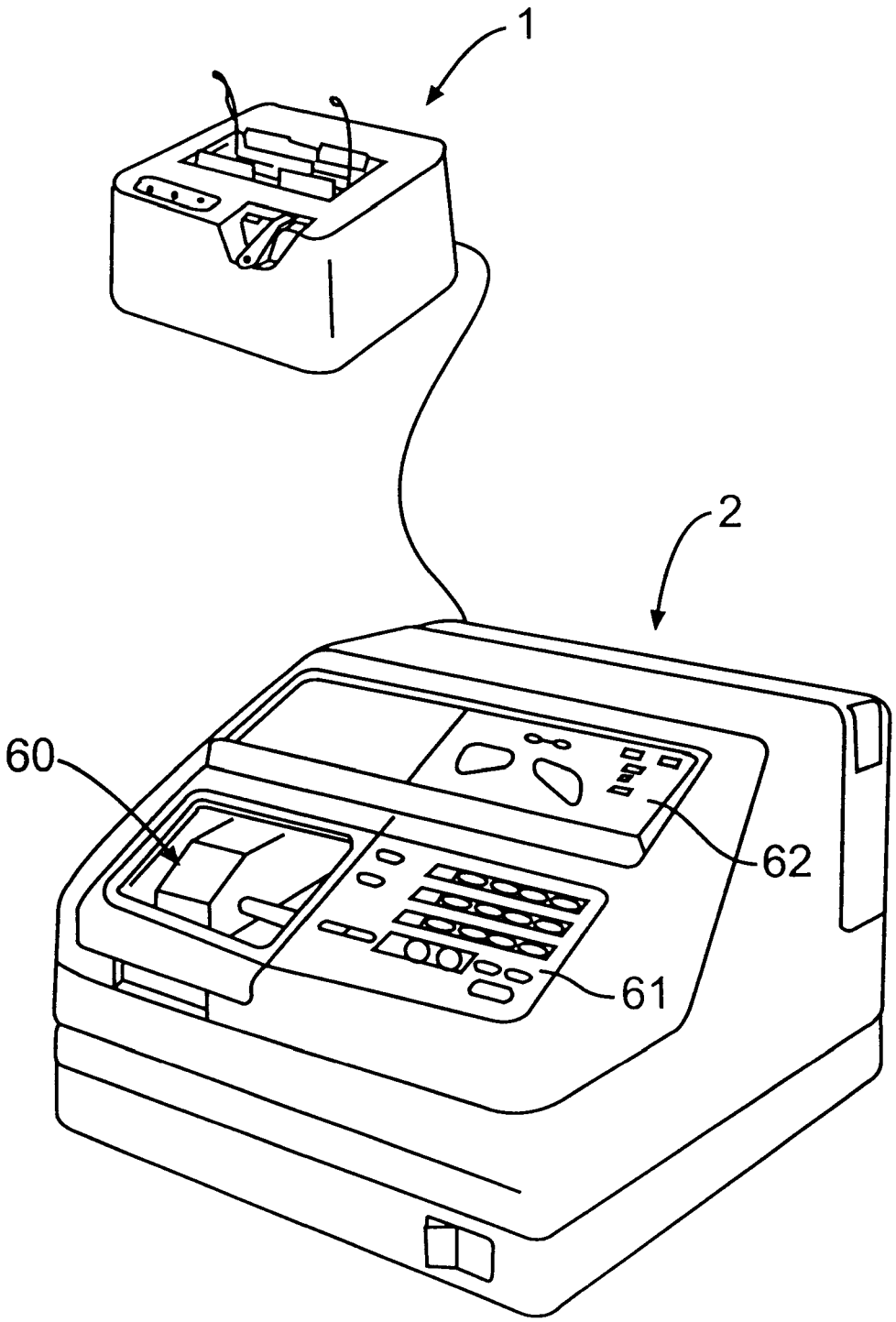
FIG. 2 is a perspective view showing the relationship between the spectacle lens shape measuring apparatus and a lens grinder.

In FIG. 2, reference character 1 denotes the spectacle lens shape measuring apparatus, reference character 2 denotes a lens grinder (a lens edging apparatus) for grinding a to-be-edged lens so as to conform correctly to the contour of an eyeglass lens, based on eyeglass frame contour data or spectacle lens shape data transmitted from the measuring apparatus 1.

Figure 3:
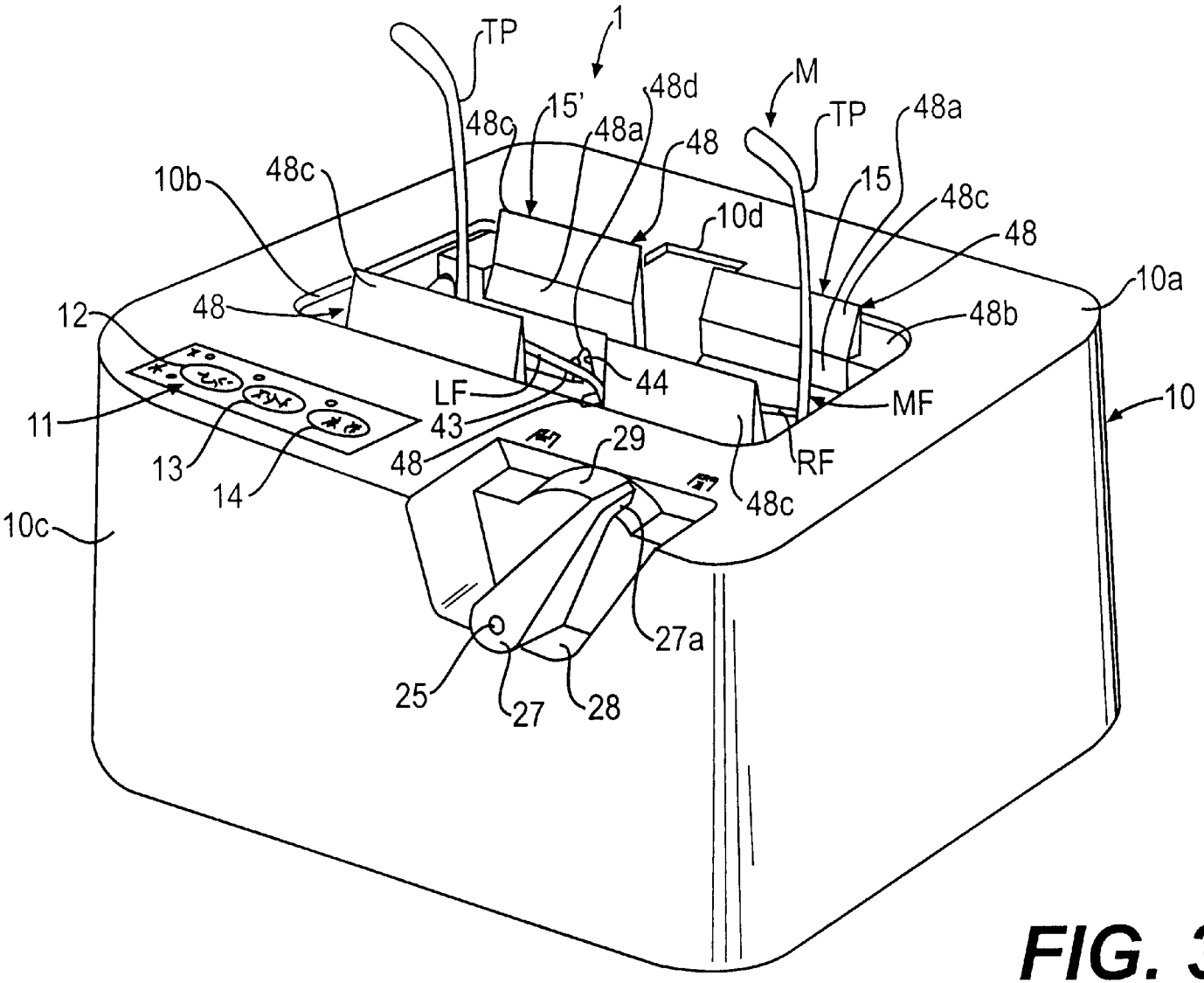
FIG. 3 is an enlarged perspective view of the measuring apparatus of FIG. 2.

As shown in FIG. 3, the measuring apparatus 1 comprises an apparatus body 10 having an opening 10*b*in the center of an upper surface 10*a*, and a switch portion 11 provided in the upper surface 10*a* of the apparatus body 10. The switch portion 11 includes a mode shifting switch 12 for shifting right and left measurement modes, a starting switch 13 for starting measurement, and a transmitting switch 14 for transmitting data.

Figures 1A, 1B, 1C, 1D:
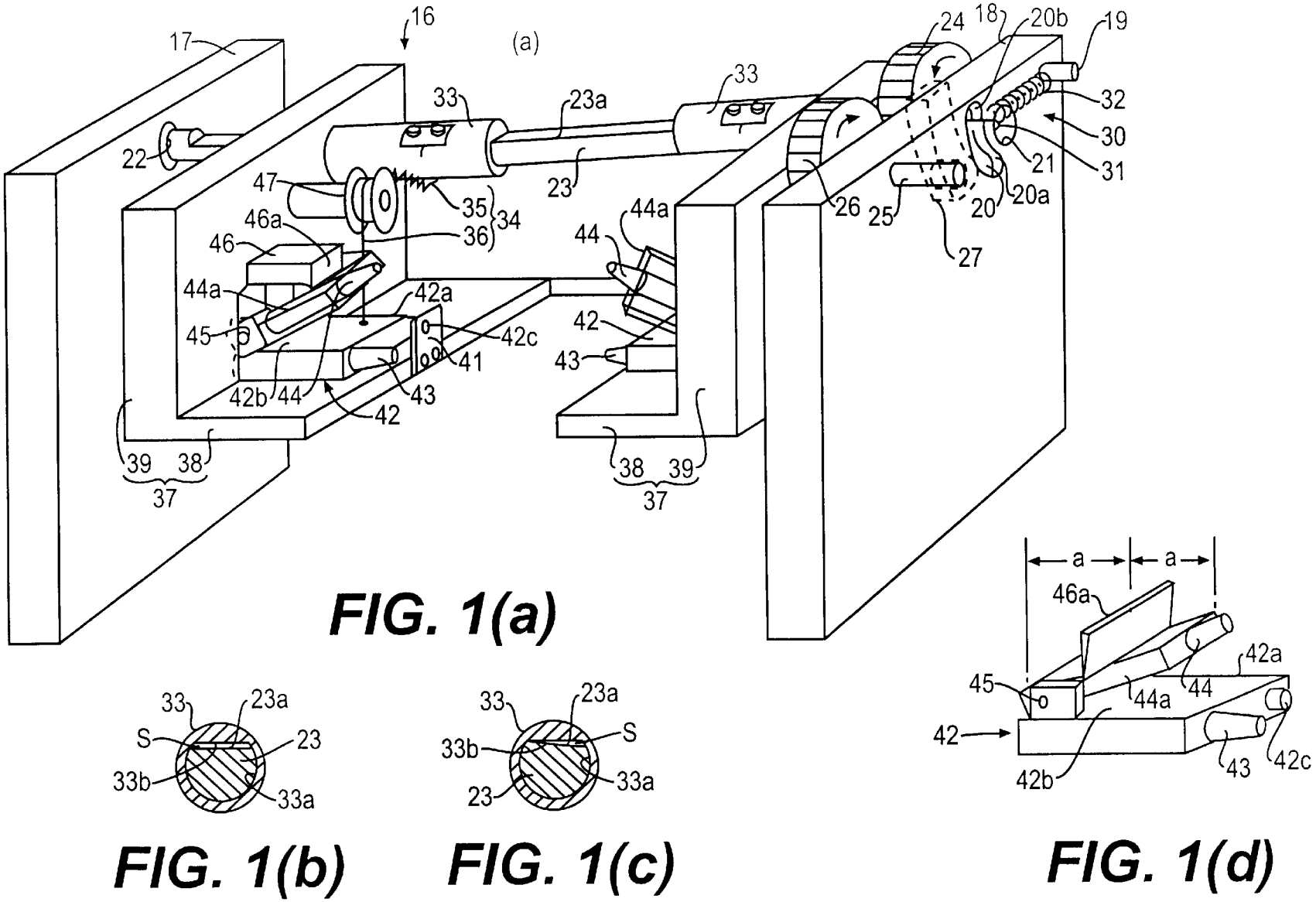
FIG. 1(*a*) is a perspective view of the main part of a spectacle lens shape measuring apparatus according to the present invention.

The measuring apparatus 1 further includes eyeglass-frame holding mechanisms (holding means) 15, 15' for holding the right and left lens frames RF, LF of the eyeglass frame MF of eyeglasses M as shown in FIG. 3, and an operating mechanism 16 therefor. Further, since each holding mechanism 15, 15' has the same structure, as shown in FIG. 1(*a*), only the holding mechanism 15 will be explained. In FIG. 1(*a*), reference characters 17, 18 denote support frameworks fixed vertically and parallel to one another on chassises (not shown) in the apparatus body 10, reference character 19 denotes a hooking pin attached to and projected from the outer surface (the surface farther away from the support framework 17) of the support framework 18, reference character 20 denotes a circular-arc-shaped slit formed in the upper part of the support framework 18, reference characters 21, 22 denote setting holes formed in the support frameworks 17, 18. Each setting hole 21, 22 is situated between the circular-arc-shaped slit 20 and the hooking pin 19, and the circular-arc-shaped slit 20 is situated on the same central line as the setting holes 21, 22.

(OPERATING MECHANISM 16)

The operating mechanism (the operating means) 16 used as means for controlling an in-and-out movement of a holding rod comprises an operational shaft 23 rotatably held on the setting hole 21, 22 of the support frameworks 17, 18, a driven gear 24 fixed to one end (the end part on the side of the support framework 18) of the operational shaft 23, a rotational shaft 25 running through the support framework 18 and the front surface 10*c* of the measuring apparatus body 10, a driving gear 26 fixed to one end of (or united with) the rotational shaft 25 and engaged with the driven gear 24, and an operating lever 27 attached to the other end of the rotational shaft 25. In FIG. 1(*a*), reference character 23*a* denotes a flat portion formed in the operational shaft 23, and the flat portion 23*a* extends as far as the parts near both ends of the operational shaft 23.

Further, a convex portion 28 is formed from a part of the upper surface 10*a* to a part of the front surface 10*c* in the measuring apparatus body 10, a circular-arc-shaped projection 29 is formed in the upper surface of the convex portion 28, and "opened" and "closed" are inscribed on either side of the projection 29 on the upper surface 10*a,* respectively. The operating lever 27 is disposed in the front of the convex portion 28, and an indicator portion 27*a,* representing a bent part formed in the upper end part of the operating lever 27, is designed to move on and along the projection 29.

Between the driven gear 24 and the hooking pin 19 is provided a two-position holding mechanism 30 (two-position holding means) for holding the frameworks (making an operation corresponding, to the "closed") and for stopping holding the frameworks (making an operation corresponding to the "opened").

The two-position holding mechanism 30 comprises the circular-arc-shaped slit 20, a movable pin 31 which is formed in and projected from a side of the driven gear 24 and also runs through the circular-arc-shaped slit 20, and a spring (an extension coil spring) 32 laid between the movable pin 31 and the hooking pin 19. As mentioned above, since the circular-arc-shaped slit 20 is situated on the same central line as the setting holes 21, 22, the driven gear 24 is also situated on the same central line as the operational shaft 23. Thereby, the movable pin 31 is held on either end portion 20*a* , 20*b* of the circular-arc-shaped slit 20 by the pulling force of the spring.

Further, the operating mechanism 16 includes a pair of barrel shafts 33, 33 which can move in a longitudinal direction on and along the operational shaft 23 and can make slight relative rotations to one another in a circumferential direction around the operational shaft 23. As shown in FIGS. 1(*b*) and 1(*c*), a small space S is defined between a flat portion 33*b* of an insertion hole 33*a* having a circular shape a part of which has been cut and the flat portion 23*a* of the operational shaft 23 in the barrel shafts 33. A string-like member 34 (only one of them is shown in FIG. 1(*a*)) having a flexible elastic portion in itself is attached to each barrel shaft 33, 33. The string-like member 34 comprises a spring (an elastic portion) 35 one end of which is attached to the barrel shaft 33, and a wire 36 connected to the other end of the spring 35.

(EYEGLASS-FRAME HOLDING MECHANISMS 15, 15')

The eyeglass-frame holding mechanism 15 includes a pair of movable frameworks or frames, preferably in the form of sliding mechanisms 37, 37 held in a longitudinal direction in the measuring apparatus body 10 such that they can move in a horizontal direction and can also move close to and away from one another. Each movable frame 37 comprises a horizontal plate portion 38, and a vertical plate portion 39 united upward with one end of the horizontal plate portion 38 so as to have an L-shape. The barrel shaft 33 is held on the vertical plate portion 39 such that it can rotate and cannot move in an axial direction.

Figure 4A:
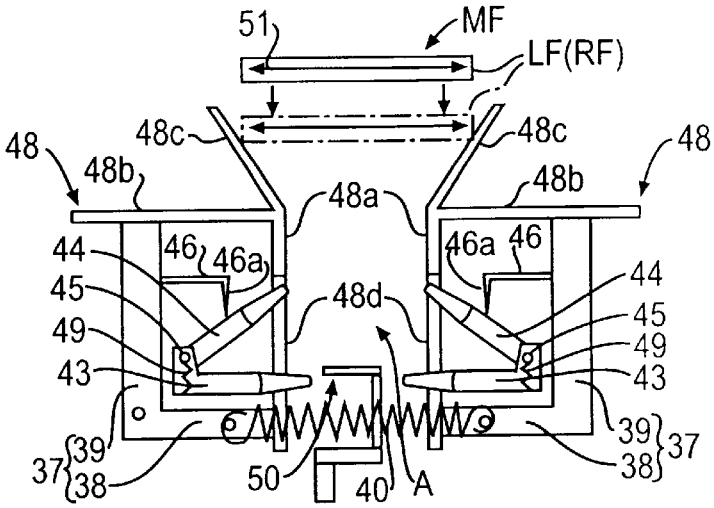
FIGS. 4(*a*) to 4(*c*) are explanatory diagrams showing the sequential operation of the measuring apparatus of FIG. 1 for holding the eyeglass frame.
Figure 4B:
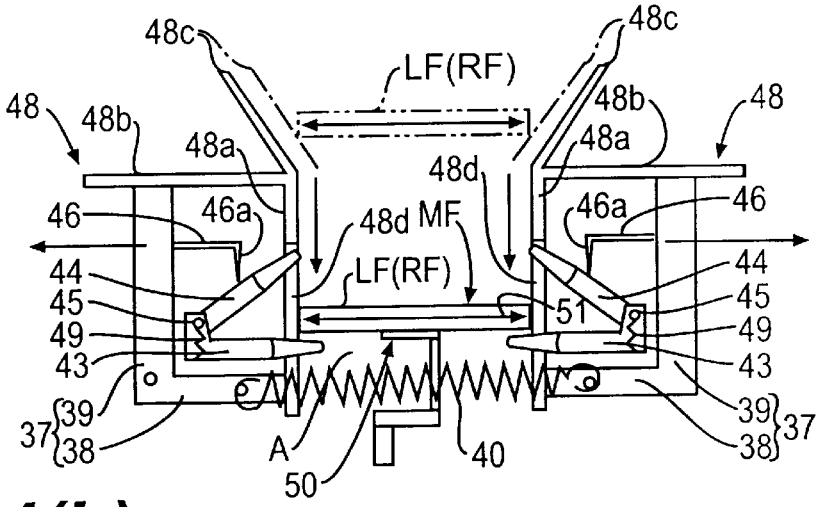
Figure 4C:
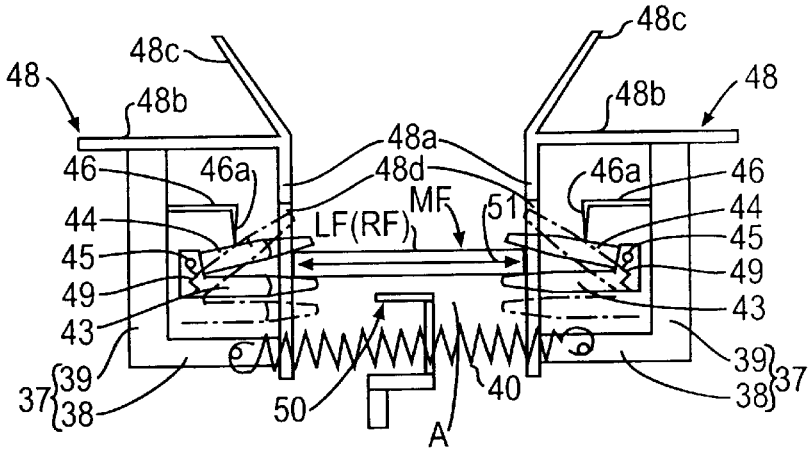

Further, the holding mechanism 15 includes an extension coil spring (urging means) 40 as shown in FIGS. 4(*a*) to 4(*c*) which is laid between the horizontal plate portions 38, 38 of the movable frames 37, 37, a holding plate 41 fixed in the middle of the front edge of the horizontal plate portion 38, and a hook-attaching plate 42 disposed between a part of the holding plate 41 projecting above the horizontal plate portion 38 and the vertical plate portion 39. The hook-attaching plate 42 is held on the holding plate 41 and the vertical plate portion 39 such that it can rotate around a shaft-shaped supporting projection 42*c* of one side portion 42*a* thereof. In FIG. 1(*a*), there is not shown a shaft-shaped supporting projection on the back side of the hook-attaching plate 42.

A shaft-shaped holding hook 43 whose front end is tapered, used as a first holding rod, is attached to the front end of the other side portion 42*b* of the hook-attaching plate 42. The rear end of a shaft-shaped holding hook 44 used as a second holding rod is held on the rear end of the other side portion 42*b* of the hook-attaching plate 42 such that it can pivot up and down on a supporting shaft 45. The holding hook 44 has a rectangular-parallelepiped base portion 44*a* as shown in FIG. 1(*d*) and also has a tapered front end portion. In addition, the holding hook 44 pivots on the supporting shaft 45 such that it becomes close to and away from the shaft-shaped holding hook 43. In other words, the holding hook 44 makes an opening and closing movements in the up and down direction in connection with the shaft-shaped holding hook 43. Besides, the front end portion of the holding hook 44 and the hook-attaching plate 42 are always urged in a direction of being opened by the force of a torsion spring (not shown) wound around the supporting shaft 45.

Further, an L-shaped engaging hook (a part of holding-rod moving-in-and-out means) 46 which moves together with the operating mechanism 16 is attached to the vertical plate portion 39 above the holding hook 44. An edge-shaped hook portion 46*a* extending below the engaging hook (movement regulating means) 46 is engaged with the holding hook 44. Thereby, when the other side portion 42*b* of the hook-attaching plate 42 is pivoted on the one side portion 42*a* thereof, the interval between the holding hooks 43, 44 becomes smaller against the force of the torsion spring (not shown). Herein, as shown in FIG. 1(*d*), the edge-shaped hook portion 46*a* of the engaging hook 46 is engaged with the substantially middle part of the holding hook 44. Between the engaging hook 46 and the barrel shaft 33 is disposed an idle pulley 47 attached rotatably to the vertical plate portion 39. The idle pulley 47 supports the wire 36, and the end of the wire 36 is fixed at the substantially middle part of the one side portion 42*a* and the other side portion 42*b* of the hook-attaching plate 42.

Further, the facing side to one another of each movable frame 37, 37 is covered with a framework guiding member 48 as shown in FIG. 4, The frame guiding member 48 comprises a vertical plate portion 48*a* fixed to the front end of the horizontal plate portion 38, a horizontal plate portion 48*b* fixed to the upper end of the vertical plate portion 39, and an inclined guiding plate portion 48*c* which is united with the corner at which the plate portion 48*a* is united with the plate portion 48*b* and is also inclined toward the horizontal plate portion 48*b*. In the vertical plate portion 48*a* is formed an opening 48*d* applied to the holding hooks 43, 44, and the holding hook 44 projects through the opening 48*d*. Also, the front end of the holding hook 43 is situated inside of the opening 48*d* in a state where the holding hooks 44,43 is opened to a maximum extent as shown in FIGS. 4(*a*) and 4(*b*). For example, holding hooks 44, 43 can be spring-biased in an open position via spring means 49.

Herein, the vertical plate portions 48*a*, 48*a* of the frame guiding members 48, 48 extend in the direction perpendicular to the direction in which the movable frames 37, 37 move close to or away from one another. The vertical plate portions 48*a*, 48*a* are situated parallel to one another and sides on which they face one another correspond to holding surfaces The holding surfaces of the pair of vertical plate portions 48*a*, 48*a* move close to and away from one another when the movable frames 37, 37 move close to or away from one another. In FIGS. 4(*a*) to 4(*b*), reference character A denotes a holding space defined between the vertical plate portions 48*a*, 48*a*.

Further, the frame-contour measuring apparatus 1 includes lens-shape measuring means (not shown) for measuring the contour of the rim of the eyeglass frame MF, that is, that of the lens frames LF, RF of the eyeglass frame MF. The lens-shape measuring means is disposed in the lower part of the holding space. A feeler 50 is moved along a groove 51 of an eyeglass frame F and thereby a position to which the feeler 50 has been moved is detected by detecting means (not shown). In this detecting operation, the lens-shape measuring means calculates a radius ρi from the geometrical center of a lens frame to the feeler 50 according to an angle θi at which the feeler 50 moves around the geometrical center. In other words, it can calculate lens contour information (θi, ρi) on the geometrical center in the polar coordinates form. Since well-known art can be applied to this structure, a detailed explanation thereof will be omitted.

Further, as shown in FIG. 2, the lens grinder 2 includes a processing portion 60 (not shown in detail) for grinding the rim of a lens to be processed. In the processing portion 60, the lens is held between a pair of lens rotational shafts of a carriage, the rotation of the lens rotational shafts and the pivotal up and down movement of the carriage is controlled according to the lens contour information (θi, ρ i), and the rim of the lens is ground with a rotating grindstone. Since this structure is well known, a detailed explanation thereof will be omitted.

Figure 6A:
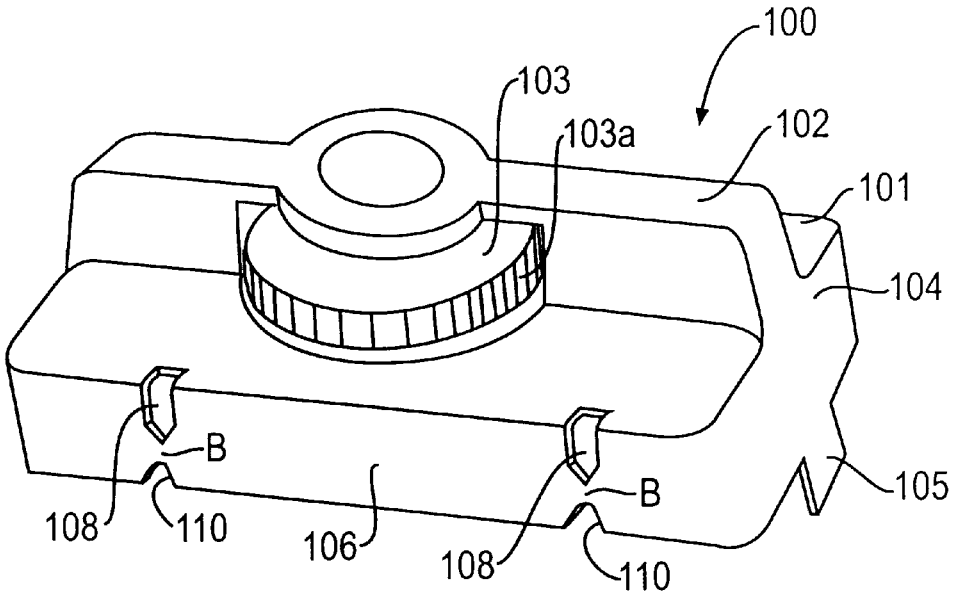
FIG. 6(*a*) is a perspective view of a template holder.
Figure 6B:
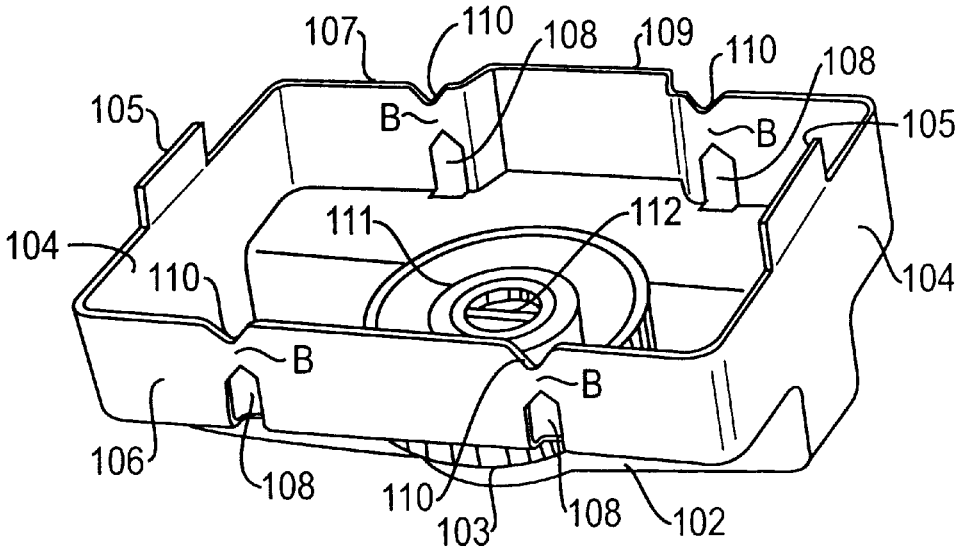

FIG. 6(*a*) shows is a template holder (a template-holding member) 100 whose bottom is opened. The template holder 100 comprises a square-shaped upper wall 101 extending in the right and left direction, a long-and-narrow rib-shaped picked portion 102 which extends in the right and left direction and is attached to the upper wall 101, and a circular picked portion 103 disposed in the middle of the picked portion 102. An uneven portion 103*a* is formed in the circumferential surface of the picked portion 103 so that it can be easily picked. Also, the template holder 100 includes end side walls 104, 104 extending down from the edges in the longitudinal direction of the upper wall 101. Hook strips 105, 105 projecting downward are formed in the end side walls 104, 104.

Further, the template holder 100 includes side walls 106, 107 extending down from the edges along the longitudinal direction of the upper wall 101. In each side wall 106, 107 is formed an insertion hole 108, 108 to insert the holding hook 44 through. In the side wall 107 is formed an expanded projection 109 which is used to specify a position at which the holding hook 44 projects outward between the insertion hole 108, 108.

The expanded projection 109 is engaged with a cut portion 10*d* formed in the upper surface 10*a* of the measuring apparatus body 10 as shown in FIG. 3, so that a situation to set the template holder 100 in can be specified. The cut portion 10*d* faces the opening 10*b* and is situated corresponding to the space between the frame guiding members 48, 48 situated behind in FIG. 3.

In the lower edge of each side wall 106, 107 are formed V-shaped cut potions 110, 110 which correspond to the insertion hole 108, 108 and are opened downward, in other words, the insertion holes 108, 108 are formed above the cut potions 110, 110. In addition, each side wall 106, 107 includes a portion B to be held between each cut potion 110, 110 and each insertion hole 108, 108.

Figure 7A:
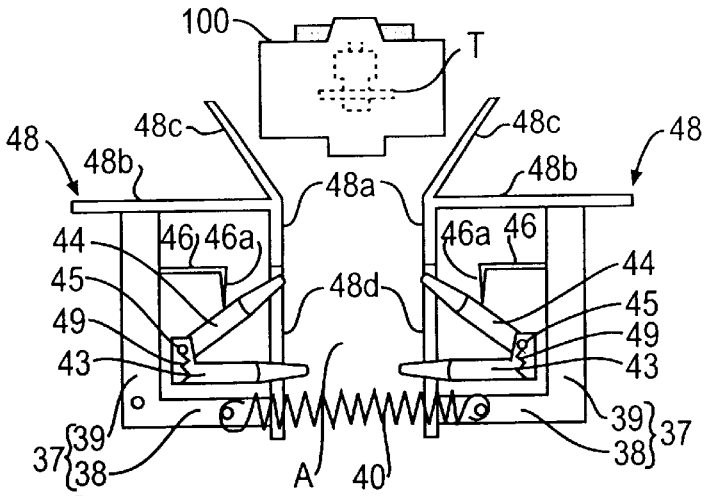
FIGS. 7(*a*) to 7(*c*) are explanatory diagrams showing the sequential operation of the measuring apparatus of FIGS. 1(*a*) to 1(*c*) when the contour of the spectacle-lens-shaped template is measured by the use of the template holder of FIGS. 6(*a*) and 6(*b*).
Figure 7B:
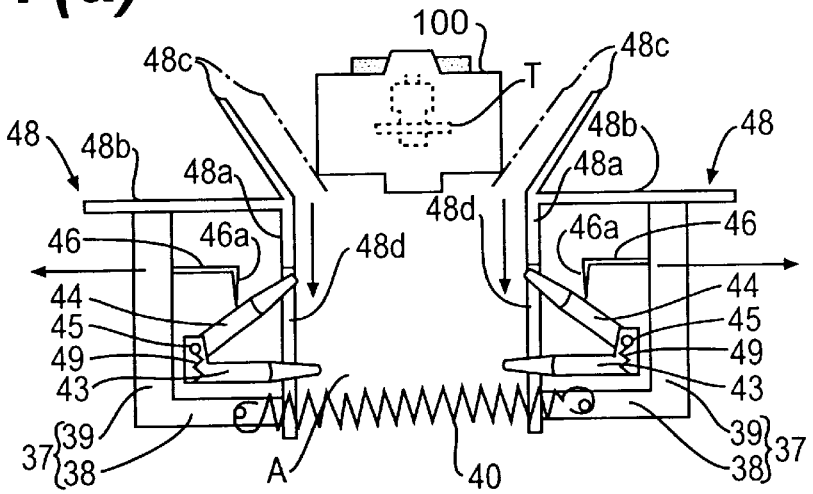
Figure 7C:
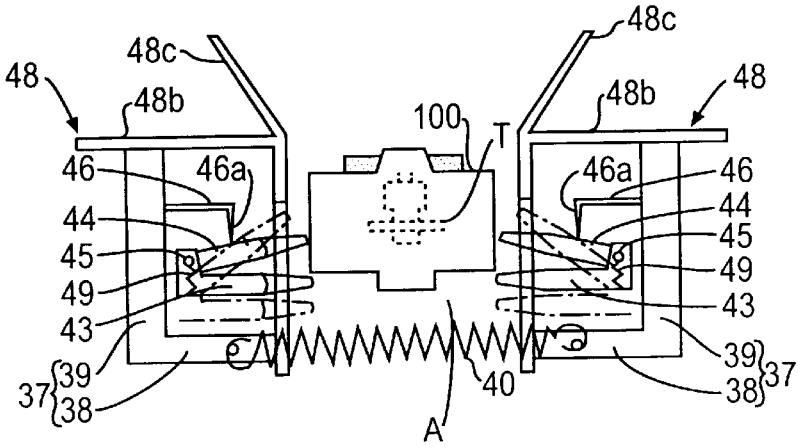

When the template holder 100 is inserted into the holding space A between the frame guiding members 48, 48 in the order of FIGS. 7(*a*) to 7(*c*), the cut potions 110, 110 are engaged with the holding hooks 43,43, respectively. Then, in this position, the holding hook 44 is inserted into the template holder 100 through the insertion hole 108, and thus the portion B of the template holder 100 is held between the holding hooks (the holding rods) 43, 44 and from above and below them, respectively. The position in which it has been held corresponds to a position in which the template holder held by the template holder 100 is measured. Herein, the template holder 100 is held between the vertical plate portions 48*a*, 48*a*.

Further, as shown in FIG. 6(*b*), a jig engagement cylindrical portion (a template holding portion) 111 is provided inside of the template holder 100, and a shaft-shaped portion of an absorbing baseplate is held removably on the jig engagement cylindrical portion 111. A template T as shown in FIGS. 7(*a*) to 7(*c*) is held on the absorbing baseplate. In FIG. 6(*b*), reference character 112 denotes a projection to determine the orientation of the absorbing baseplate. Since the same well-known art as Japanese Patent Application No. Hei 2-113840 can be applied to this structure, a detailed explanation thereof will be omitted.

In the case where the template holder 100 is used as shown in FIGS. 7(*a*) to 7(*c*), template-holder detecting means (not shown) detects the template holder 100, and the detection signal is inputted to an arithmetic control circuit (not shown), and then the arithmetic control circuit (arithmetic means) brings a feeler used for a template (a measuring element used for a template), instead of the feeler 50, into contact with a template T so as to measure the contour of the template T. Herein, this template feeler is also set inside of the lens-shape measuring means. Since the same well-known art as Japanese Patent Application No. Hei 8-320468 can be applied to the structure of the lens-shape measuring means including the feeler 50 or the template feeler, a detailed explanation thereof will be omitted. Further, instead of such automatic detection, a well-known manually raising-up and bringing-clown type of template feeler as disclosed by Japanese Patent Application No. Hei 2-113840 can also be used.

Next, an explanation will be made of the operation of the thus constructed apparatus.

In the apparatus having this construction, the inclined guiding plate portions 48*c,* 48*c* of the frame guiding members 48, 48 are inclined in a direction of becoming more distant from one another as running upward. Thus, when the eyeglass frame MF of eyeglasses is set between the inclined guiding plate portions 48*c,* 48*c* as shown in FIG. 4(*a*) and then is pressed down from above against the force of the coil spring 40, the interval of the frame guiding members 48, 48, that is, that of the movable frameworks 37, 37, becomes wider by the guiding action of the inclined guiding plate portions 48*c,* 48*c,* so that the rim of the eyeglass frame MF (i.e., the lens frames LF, RF of the eyeglass frame MF), is moved onto the holding hooks 43, 43 and is hooked thereon.

Subsequently, when the operating lever 27 is turned from the position "opened" to the position "closed", this turning is transmitted to the barrel shaft 33 via the rotational shaft 25, the gears 26, 24, and the operational shaft 23, and a part of the spring 35 is wound around the barrel shaft 33. Thereby, the hook-attaching plate 42 is pivoted upward on the one side portion 42*a* via the wire 36 connected to the spring 35, and the interval of the holding hooks 43, 44 becomes closer as shown in FIG. 4(*c*), and the rim of the eyeglass frame MF is held between the holding hooks 43, 44, as shown in FIG. 4(*c*). In this position, the movable pin 31 is held on the lower end portion 20*a* of the circular-arc-shaped slit 20 by the force of the spring 32.

In order to remove the rim of the eyeglass frame MF (i.e., the lens frames LF, RF of the eyeglass frame MF) from between the holding hooks 43, 44, the operating lever 27 is operated in an opposite way to the aforementioned operation, so that the constituent members are operated reversely.

(ANOTHER EMBODIMENT)

The present invention is not limited to the aforementioned embodiment. A construction shown in FIGS. 5(*a*) to 5(*c*) may also be adopted. In the embodiment shown in FIGS. 5(*a*) to 5(*c*), the engaging hook 46 constructed as shown in FIGS. 1(*a*) to 4(*c*) is omitted, and the construction of the holding hook 44 is changed. The other constructions in this embodiment of FIGS. 5(*a*) to 5(*c*) are the same as those shown in FIG. 1(*a*).

Figure 5A:
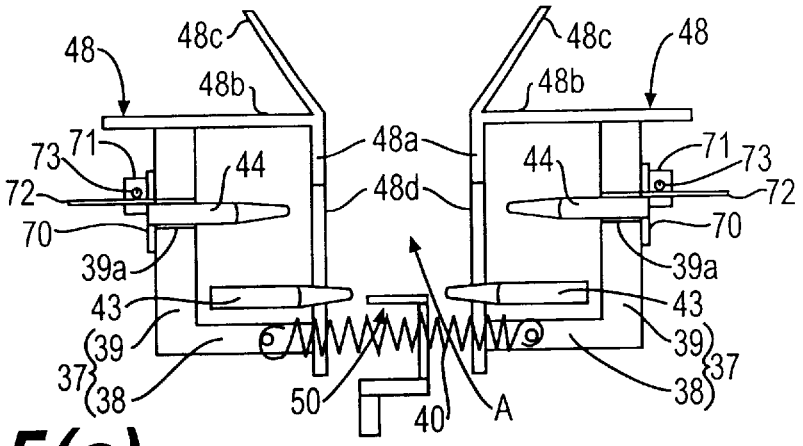
FIGS. 5(*a*) to 5(*c*) are explanatory diagrams showing another example of the sequence operation of the measuring apparatus according to the present invention.
Figure 5B:
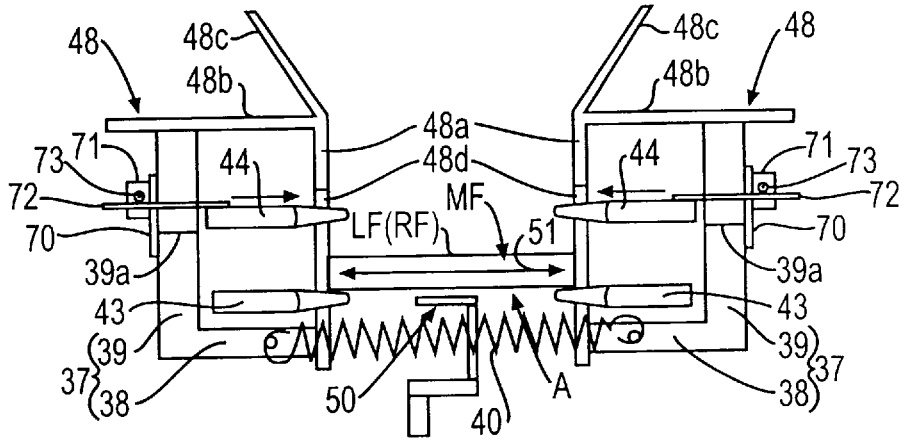
Figure 5C:
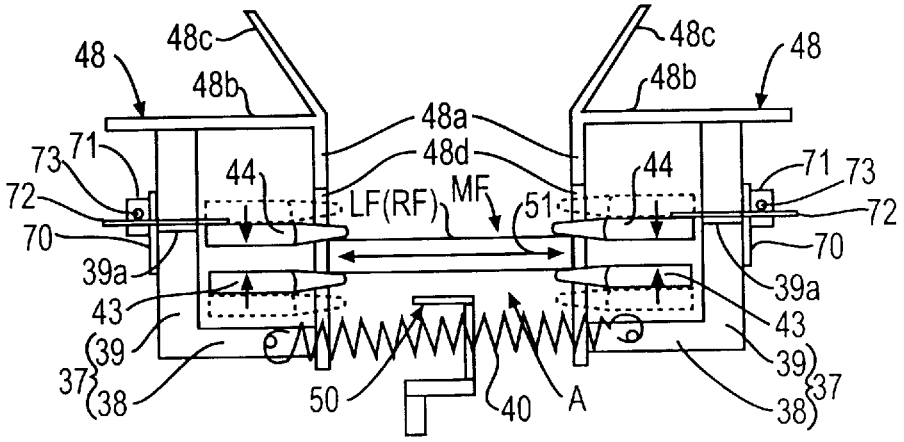

In FIGS. 5(*a*) to 5(*c*), the holding hook 43 is held on the movable framework 37 in the same way as shown in FIG. 1(*a*). A through hole 39*a* is formed in the vertical plate portion 39 of the movable frame 37, and a guide rail 70 is attached to the back surface of the vertical plate portion 39. A slider 71 is held on the guide rail 70 such that it can move up and down, and a rack bar 72 passing through the through hole 39*a* is held on the slider 71 such that it can move right and left in FIGS. 5(*a*) to 5(*c*). A driving pinion 73 held on the slider 71 is engaged with the rack bar 72, and a holding hook 44 is fixed onto the end part of the rack bar 72 on the side of the opening 48*d*.

Further, the slider 71 is moved up and down by a driving motor (not shown), and the driving pinion 73 is rotated by a driving motor (not shown). The up-and-down motion of the slider 71 by the driving motor and the rotation of the driving pinion 73 by the driving motor will be made with timing mentioned in the following.

When the operating lever 27 shown in FIG. 2 is situated in the position "opened", as shown in FIG. 5(*a*), the base portion of the holding hook 44 is situated inside of the through hole 39*a,* and the front end of the holding hook 44 is located at a retreat position between the vertical plate portions 39, 39 such that it does not project toward the space between the vertical plate portions 48*a,* 48*a*.

In this state, as shown in FIG. 4(*a*), when the eyeglass frame MF of eyeglasses is disposed between the inclined guiding plate portions 48*c,* 48*c* and is pressed down from above against the force of the coil spring 40, the interval of the frame guiding members 48, 48, i.e., that of the movable frames 37, 37, becomes wider by the guiding action of the inclined guiding plate portions 48*c,* 48*c,* so that the rim of the eyeglass frame MF (i.e., the lens frames LF, RF of the eyeglass frame MF) is moved onto the holding hooks 43, 48 and is hooked on the holding hooks 43, 43, Subsequently, when turned from the position "opened" to the position "closed", the operating lever 27 turns on a switch (not shown) in the beginning of its turning, and the driving pinion 73 is rotated by a driving motor. Next, as shown by an arrow in FIG. 5(*b*), the rack bar 72 and the holding hook 44 move toward the opening 48*d* of the vertical plate portion 48*a,* the front end of the holding hook 44 then projects from the opening 48*d,* as shown by in FIG. 5(*b*), and the base portion of the holding hook 44 comes off the through hole 39*a*. Thereafter, the slider 71 is moved down by a driving motor (not shown), and the holding hook 44 is moved down from a position shown by a broken line to a position shown by a solid line in FIG. 5(*c*).

On the other hand, as described above, when the operating lever 27 is turned to the position "closed", this turning is transmitted to the barrel shaft 33 via the rotational shaft 25, the gears 26, 24, and the operational shaft 23, and a part of the spring 35 is wound around the barrel shaft 33. Thereby, the hook-attaching plate 42 is pivoted upward on the one side portion 42*a* via the wire 36 connected to the spring 35, the holding hook 48 is then moved up from the position shown by the broken line to the position shown by the solid line in FIG. 5(*c*), the interval of the holding hooks 43, 44 then becomes closer, and the rim of the eyeglass frame MF (i.e., the lens frames LF, RF of the eyeglass frame MF) is held between the holding hooks 43, 44. In this position, the movable pin 31 is held on the lower end portion 20*a* of the circular-arc-shaped slit 20 by the force of the spring 32.

The lens frames LF, RF of the eyeglass frame MF is removed from between the holding hooks 43, 44 by operating the operating lever 27 in an opposite way to the aforementioned way. The reverse operation of the operating lever 27 allows a second switch (not shown) to be turned on, thereby the constituent members are operated reversely.

In the embodiments, a right and left movement (i.e., a movement passing through the opening 48*d*) of the holding hook 44 and an up and down movement of the holding hook 44 are performed by a driving motor. However, the movements thereof may also be performed by a solenoid, and further, a movement, such as that shown in FIG. 5, can also be performed by a wire or a gear driving mechanism which is designed to move together with the operating lever 27. Further, in the embodiments, for convenience of illustration, a description was given of the structure in which the movable frames 37, 37 are urged by the coil spring 40 in a direction to approach each other directly, because this structure is not essential in the present invention. However, in practice, a mechanism provided with a wire, a puley, and the like, or a mechanism provided with gears is used to allow the frames 37, 37 to relatively proceed to and recede from each other such that one of the frames 37, 37 is allowed to proceed to and recede from a central reference position therebetween, and correspondingly with the movement of this framework, the other framework is allowed to proceed to and recede from the central reference position.

As can be seen from the aforementioned explanation, the spectacle lens shape measuring apparatus of the present invention is capable of measuring a template with less labor and more efficiently than the conventional apparatus.

What is claimed is:

1. A spectacle lens shape measuring apparatus for measuring a contour of a rim of an eyeglass frame and a contour of a template, the apparatus comprising:

a pair of first and second holding rods for holding the rim of the eyeglass frame from above and below, respectively; and a template holding member having a portion to be held by means of said pair of first and second holding rods, wherein the template holding member comprises an upper wall having a square shape and a side wall extending downward from an edge of said upper wall, said upper wall having a template holding portion in a middle of an under surface of said upper wall, and said side wall having a V-shaped notch to be engaged with the first holding rod at a lower edge of said side wall, and an insertion hole into which the second holding rod is inserted, said insertion hole being situated above said notch, and a part between said notch of said side wall and said insertion hole being said portion to be held.

2. The apparatus of claim 1, further comprising:

a pair of movable frames configured to set a position at which said eyeglass frame and said template holding member are held during measurement, said pair of movable frames being configured to reciprocate freely toward each other and away from each other, and said pair of movable frames being biased toward each other.

3. The apparatus of claim 2, wherein:

the movable frames have vertical plate portions parallel to each other and perpendicular to a direction in which said pair of movable frames move toward and away from each other, said vertical plate portions defining a space therebetween for holding said eyeglass frame or said template holding member and each vertical plate portion defining an opening through which said first and second holding rods are projected into said space, and further wherein each said pair of movable frames holds base portions of said first and second holding rods.

4. The apparatus of claim 3, wherein the first holding rods project into said space, and the second holding rods are held by the movable frames so as to freely project and retract through said respective openings and freely move toward and away from the respective first holding rods.

5. The apparatus of claim 4, wherein:

said first and second holding rods are connected to each other at said base portions so that front ends of said first and second holding rods freely move up and down in an opening and closing movement and are spring-biased in an open direction.

6. The apparatus of claim 5, wherein the first holding rods are configured to move up and down relative to the respective vertical plate portion through which each said first holding rod projects such that the longitudinal axis of each said first holding rod remains perpendicular to said respective vertical plate portion.

7. The apparatus of claim 6, wherein the second holding rods move in an opening and closing movement with respect to the first holding rods such that each of the second holding rods projects through the respective openings defined, by each of said vertical plate portions and into said space defined between the plate portions.

8. The apparatus of claim 7, wherein an actuator moves each of said first holding rods and a regulator moves each of said second holding rods in response to respective movement of each of said first holding rods.

9. An apparatus for measuring a contour of a rim of an eyeglass frame and a contour of a lens shape template, the apparatus comprising:

a pair of movable frames configured for reciprocal movement relative to each other, said pair of movable frames being configured to set a position at which said eyeglass frame and a template holding member are measured and said pair of movable frames being configured to reciprocate freely toward each other and away from each other, and biased in a direction toward each other, said movable frames further having vertical plate portions parallel to each other and perpendicular to a direction in which said pair of movable frames move toward and away from each other, said vertical plate portions defining a space therebetween for holding said eyeglass frame of said template holding member and each vertical plate portion defining an opening through which first and second holding rods are projected into said space, and further wherein each said pair of movable frames hold base portions of said first and second holding rods;

said first and second holding rods disposed on each of the pair of movable frames and configured to engage the rim of the eyeglass frame from above and below, respectively, to hold the eyeglass frame, and said first and second holding rods also being configured to engage portions of said template holding member to hold said template holding member, said first and second holding rods further being connected to each other at said base portions so that front ends of said first and second holding rods freely move up and down in an opening and closing movement and are spring-biased in an open direction, and wherein said first holding rods project into said space and the second holding rods are held by the respective movable frames so as to freely project and retract through said respective openings and freely move toward and away from the respective first holding rods.

10. The apparatus of claim 9, wherein the first holding rods are configured to move up and down relative to said respective vertical plate portions through which each of the first holding rods projects such that the longitudinal axis of each of the first holding rods remains perpendicular to the respective vertical plate portion through which each first holding rod projects.

11. The apparatus of claim 10, wherein the second holding rods move in an opening and closing movement with respect to the first holding rods such that each of the second holding rods projects through the respective openings defined by each of said vertical plate portions and into said space defined between the plate portions.

12. The apparatus of claim 11, wherein an actuator moves each of said first holding rods and a regulator moves each of said second holding rods, in response to respective movement of each of said first holding rods.

* * * * *